US006416201B1

(12) United States Patent
Strand et al.

(10) Patent No.: US 6,416,201 B1
(45) Date of Patent: Jul. 9, 2002

(54) ILLUMINATED SIGN WITH LAMP MASKS FOR UNIFORM ILLUMINATION

(75) Inventors: Neal T. Strand, Woodbury; David G. Freier; Ellen O. Aeling, both of St. Paul, all of MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/539,820

(22) Filed: Mar. 31, 2000

(51) Int. Cl.[7] ..... F21V 11/14

(52) U.S. Cl. ..... 362/224; 362/223; 362/237; 362/240; 362/248; 362/351

(58) Field of Search ..... 362/125, 217, 362/223, 224, 225, 235, 236, 237, 240, 248, 367, 351, 355, 812

(56) References Cited

U.S. PATENT DOCUMENTS

| | | | | | |
|---|---|---|---|---|---|
| 2,050,429 | A | * | 4/1936 | Dorey et al. | 362/249 |
| 2,939,235 | A | | 6/1960 | Wamser | 40/132 |
| 4,418,378 | A | * | 11/1983 | Johnson | 362/97 |
| 4,602,448 | A | | 7/1986 | Grove | 50/541 |
| 4,916,580 | A | * | 4/1990 | Sano et al. | 362/29 |
| 5,079,681 | A | * | 1/1992 | Baba et al. | 362/263 |
| 5,195,818 | A | * | 3/1993 | Simmons et al. | 362/224 |
| 5,379,540 | A | | 1/1995 | Howard | 40/558 |
| 5,818,083 | A | | 10/1998 | Ito | |
| 5,847,411 | A | | 12/1998 | Morii | |
| 5,962,872 | A | | 10/1999 | Zhang et al. | |
| 6,024,462 | A | | 2/2000 | Whitehead | 263/31 |
| 6,042,243 | A | * | 3/2000 | Grill et al. | 362/125 |
| 6,093,937 | A | | 7/2000 | Yamazaki et al. | |
| 6,129,447 | A | * | 10/2000 | Futami | 362/522 |

FOREIGN PATENT DOCUMENTS

| | | | |
|---|---|---|---|
| DE | 297 07 776 | 9/1997 | G09F/15/00 |
| EP | 0 552 967 | 7/1993 | G09F/13/04 |
| FR | 2 347 739 | 11/1977 | G09F/13/04 |
| JP | 08-148694 | 6/1996 | |

OTHER PUBLICATIONS

JP 08–148694 English abstract.

* cited by examiner

*Primary Examiner*—Sandra O'Shea
*Assistant Examiner*—Ismael Negron
(74) *Attorney, Agent, or Firm*—James D. Christoff

(57) ABSTRACT

An illuminated sign system provides uniform illumination over the lamp face by using partially transmissive lamp masks located between the lamps and the sign face. The sign face itself also diffusely reflects at least a majority of light incident on its second surface back towards the interior of the sign. The lamp spacing ratio in the illuminated signs can be increased, e.g., to a ratio of 3:1 or more, and, possibly, to a ratio of 4:1 or more.

22 Claims, 3 Drawing Sheets

ILLUMINATED SIGN WITH LAMP MASKS FOR UNIFORM ILLUMINATION

FIELD OF THE INVENTION

The present invention relates to the field of illuminated signs. More particularly, the present invention provides illuminated signs including partially transmissive lamp masks.

BACKGROUND

Illuminated signs, sometimes referred to as light boxes, are often used to enhance the presentation of images and/or text. Examples of illuminated signs can be found in, e.g., airports, mass-transit stations, shopping malls and other public places. The signs typically include an enclosure having an illuminated face over which a graphic (including images and/or text) is located. The illumination is typically provided by an array of elongated fluorescent lamps located behind the sign face and within the enclosure. The images and/or text in the graphic typically include transparent or translucent portions to enhance their visibility when placed over the illuminated face.

In most situations, it is desirable that the sign have a face that exhibits substantially uniform illumination over its entire surface. In conventional illuminated sign design, the thickness of the sign enclosure is controlled by the distance of the centers of the lamps from the sign face. The distance of the lamps from the sign face is, in turn, controlled by the distance between the lamps within the sign. The industry standard lamp spacing ratio required to provide sufficient, uniform illumination is 2:1, i.e., the distance between adjacent lamps is about twice the distance from the lamp centers to the sign face. In many conventional signs, this ratio yields illuminated signs with an overall thickness of about 4 inches (10 cm) and a lamp spacing of about 5–6 inches (13–15 cm).

Spacing the lamps in a conventional sign farther apart than is discussed above can result in non-uniform illumination, i.e., portions of the face will be significantly darker or brighter than others. Those non-uniformities can detract from the graphic located on the sign face.

In many cases the thickness of the illuminated signs can be problematic. For example, the signs may protrude out from a wall far enough to create a potential hazard. In some public locations, the distance by which signs may protrude from a wall surface is regulated to, e.g., 4 inches (11 cm) or less.

One potential approach to reducing illuminated sign thickness is to place the lamps closer together. As a result, the distance from the lamp centers to the sign face can be reduced (using. e.g., the 2:1 ratio discussed above). One significant drawback to this approach is, however, that the costs of operating the sign are also increased.

Furthermore, placing the lamps closer together may result in unacceptable increases in luminance of the sign face. Signs that are too bright may detract from the presentation of the graphics placed on them. For example, a commonly accepted range of luminance for outdoor illuminated signs is about 100–300 Footlamberts (340–1030 Candela/$m^2$). Exceeding this range may result in a sign that is unacceptably bright and washed out—in addition to requiring additional energy to operate.

SUMMARY OF THE INVENTION

The present invention provides an illuminated sign system that provides uniform illumination over the lamp face by using partially transmissive lamp masks located between the lamps and the sign face. The sign face itself also diffusely reflects a majority of light incident on its second surface back towards the interior of the sign. The combination of a diffusely reflective lamp face and partially transmissive lamp masks enhances uniformity of the sign face illumination.

One advantage of illuminated signs manufactured according to the present invention is that the lamp spacing ratio can be increased, e.g., to a ratio of 3:1 or more, and, possibly, to a ratio of 4:1 or more. Surprisingly, these increases in the lamp spacing ratio can be employed with an actual increase in illumination uniformity and while maintaining acceptable brightness.

In one aspect, the present invention provides an illuminated sign including a face having an interior surface facing an interior of the sign and an exterior surface facing away from the interior of the sign, wherein the face diffusely reflects a majority of light incident on the interior surface of the face; a back located opposite the face, wherein the back includes a back surface oriented towards the face, wherein the back surface diffusely reflects a majority of light incident on the back surface; a plurality of lamps located between the face and the back, wherein the lamps and the face are located with a lamp spacing ratio of about 3:1 or more; and a lamp mask located between each of the lamps and the face, wherein each lamp mask transmits only a portion of light incident thereon from its respective lamp.

In another aspect, the present invention provides an illuminated sign including a face having an interior surface facing an interior of the sign and an exterior surface facing away from the interior of the sign, wherein the face diffusely reflects a majority of light incident on the interior surface of the face; a back located opposite the face, wherein the back includes a back surface oriented towards the face, wherein the back surface diffusely reflects a majority of light incident on the back surface; a plurality of lamps located between the face and the back; and a lamp mask located between each of the lamps and the face, wherein each lamp mask diffusely transmits about 20% or less of light incident thereon from its respective lamp.

In another aspect, the present invention provides an illuminated sign including a face having an interior surface facing an interior of the sign and an exterior surface facing away from the interior of the sign, wherein the face diffusely reflects about 80% or more of light incident on the interior surface of the face; a back located opposite the face, wherein the back includes a back surface oriented towards the face, wherein the back surface diffusely reflects about 90% or more of light incident on the back surface; a plurality of lamps located between the face and the back, wherein the lamps and the face are located with a lamp spacing ratio of about 3:1 or more; and a lamp mask located between each of the lamps and the face, wherein each lamp mask diffusely transmits about 20% or less of light incident thereon from its respective lamp over an attenuation arc of about 180° or less.

As used in connection with the present invention, "light" means electromagnetic radiation in wavelengths that are typically visible to the unaided human eye.

The reflective and transmissive properties of the various components of the signs of the present invention are measured using light approaching the surface of the component at a 90° angle to that surface. Such light will be referred to herein as "normal incident light." Furthermore, the reflective or transmissive values recited are average values over the wavelength range of 500–600 nanometers.

"Interior light" as used in connection with the present invention means light that is located within the interior of the sign, i.e., between the face and back of the sign.

These and other various features and advantages of the invention are described below with reference to various illustrative embodiments of the invention and examples of the invention.

DESCRIPTION OF ILLUSTRATIVE EMBODIMENTS OF THE INVENTION

Figure 1:
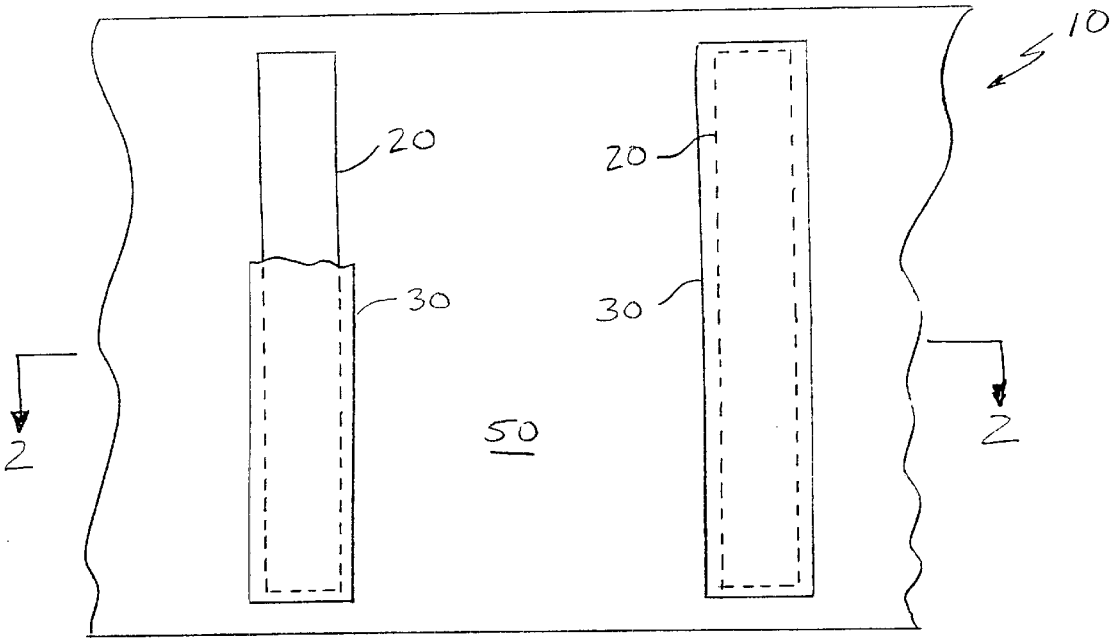
FIG. 1 is a plan view of a portion of one illumination sign system according to the present invention with the face removed to expose the lamp masks and lamps located therein.
Figure 2:
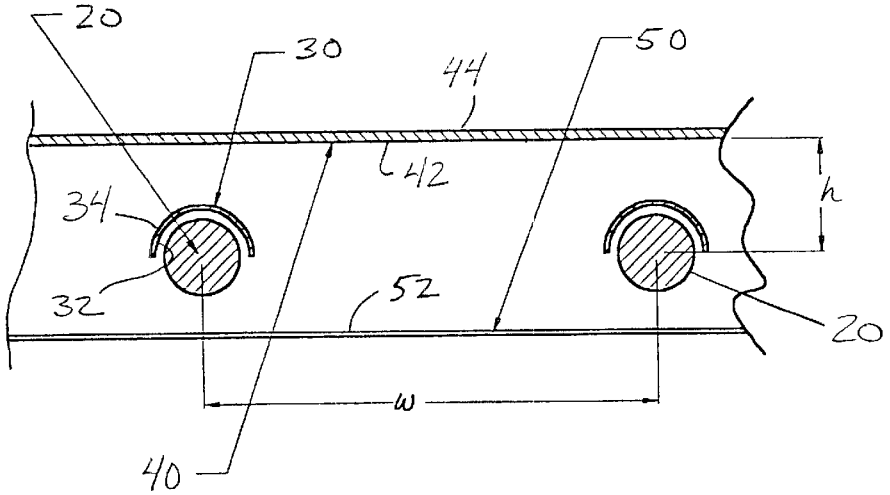
FIG. 2 is cross-sectional view the sign system of FIG. 1 including the face, with the cross-section taken along line 2—2 in FIG. 1.

Referring to FIGS. 1 and 2, the illustrated embodiment of an illuminated sign 10 includes lamps 20 located therein. The lamps 20 are preferably elongated tubular fluorescent lamps as are well known in the art. A sign face 40 is located in front of the lamps 20 and a sign back 50 is located behind the lamps 20.

The sign face 40 and back 50 combine to define an interior volume of the sign 10. Although not illustrated in FIG. 2, the sign 10 may also include side walls that further define the interior volume along the edges of the face 40 and back 50. For the purposes of the present invention, such side walls may be considered to form a part of the back 50 of the sign 10 due to their role in further defining the interior volume of the sign 10. It may be preferred that such side walls be provided to retain light within the sign 10 until it exits through the face 40, as well as to reduce or prevent the infiltration of dust, dirt, debris and other contaminants from the interior volume of the sign 10. Some openings may, however, be provided to assist in dissipating thermal energy generated within the interior volume of the sign 10.

A lamp mask 30 is located between each of the lamps 20 and the face 40. Each of the lamp masks 30 is partially transmissive to light incident on the lamp surface 32, i.e., the surface of the lamp mask 30 facing the lamp 20. It is preferred that the lamp masks 30 are diffusely transmissive. It may be preferred that the lamp masks 30 reflect a substantial portion of the light that is not transmitted, although the components of the lamp masks may exhibit some absorption. At the upper end, it may be preferred that the lamp masks 30 transmit about 30% of normal incident light or less, more preferably about 20% or less, and even more preferably about 15% or less. At the lower end, it may be preferred that the lamp masks 30 transmit about 5% or more of normal incident light, more preferably about 10% or more. It may further be preferred that the exterior surface 34 of the lamp masks 30 be diffusely reflective.

The sign face 40 of the sign 10 diffusely reflects at least a majority of the incident interior light, i.e., light that is incident on the interior surface 42 of the sign face 40 from the interior volume of the sign 10. The sign face 40 preferably diffusely reflects about 70% or more of normal incident interior light, more preferably about 80% or more, and even more preferably about 90% or more.

The exterior surface 44 of the sign face 40 is preferably receptive to the application of graphics either directly onto the surface 44 or in the form of films or sheets attached to or placed directly in front of the face 40.

The back 50 of the sign 10 reflects at least a majority of the incident interior light, i.e., light that is incident on the interior surface 52 of the back 50 from the interior volume of the sign 10. The back 50 preferably diffusely reflects about 80% or more of normal incident interior light, more preferably about 90% or more. Although the back 50 may be specularly reflective, it is preferably diffusely reflective for interior incident light.

By using the combination of a diffusely reflective face 40 and partially transmissive lamp masks 30, the spacing between lamps 20 can be increased while, at the same time, the distance of the face from the lamps can be decreased while maintaining acceptable illumination uniformity. FIG. 2 illustrates the lamp spacing ratio, with the distance between pairs of adjacent lamps 20 represented as w, while the distance between the centers of the lamps 20 to the sign face 40, represented as h. The lamp spacing ratio w:h is, in conventional illuminated signs, typically about 2:1. In illuminated signs manufactured according to the present invention, however, that ratio is preferably about 3:1 or more, and even more preferably about 4:1 or more. In some instances it may be preferred that the lamp spacing ratio be about 4:1.

It may be even more beneficial to provide a highly reflective back in combination with the partially transmissive lamp masks and diffusely reflective sign face. Proper matching of the reflective properties of the various components can result in a sign that provides acceptable illumination, both in terms of brightness and uniform luminance, with lamp spacing ratios that are significantly larger than considered acceptable by conventional standards. It may be preferred to provide, in combination for example, a sign that includes lamp masks that diffusely transmit about 20% or less of light incident on their respective lamp surfaces, a face that diffusely reflects about 80% or more of normal incident interior light, and a back that reflects about 90% or more of normal incident interior light. In such a sign, it may further be preferable to provide a lamp spacing ratio of about 3:1 or more, more preferably about 4:1 or more, and in some instances about 4:1.

In another combination, it may be preferred to provide, for example, a sign that includes lamp masks that diffusely transmit about 5% to about 15% of light incident on their respective lamp surfaces, a face that diffusely reflects about 85% to about 90% of normal incident interior light, and a back that reflects about 90% or more of normal incident interior light. In such a sign, it may further be preferable to provide a lamp spacing ratio of about 3:1 or more, more preferably about 4:1 or more, and, in some instances about 4:1.

In still another combination, it may be preferred to provide, for example, a sign that includes lamp masks that diffusely transmit about 10% of light incident on their respective lamp surfaces, a face that diffusely reflects about 90% of normal incident interior light, and a back that reflects about 94% or more of normal incident interior light. In such a sign, it may further be preferable to provide a lamp spacing ratio of about 3:1 or more, more preferably about 4:1 or more, and, in some instances about 4:1.

Figure 3:
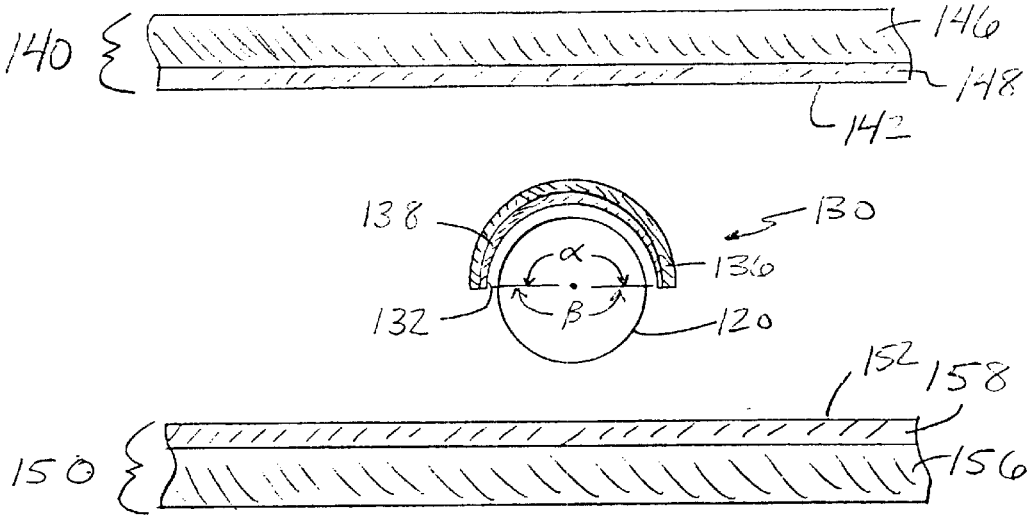
FIG. 3 is a cross-sectional view of embodiments of the face, lamp mask and back of one illuminated sign system according to the invention.

FIG. 3 further illustrates various components of the sign in more detail, including a lamp mask 130, face 140 and back 150. The lamp mask 130 is depicted as spaced from the surface of the lamp 120 and the mask 130 may be provided as a separate article such that the lamp 120 may be replaced separately from the lamp mask 130.

The lamp mask 130 includes a substrate 136 lined on the surface facing the lamp 120 with a layer 138. The substrate 136 and layer 138 may be provided of any suitable combination of materials that transmit light incident on the lamp surface 132 of the lamp mask 130 at the transmission levels discussed above. It may be further preferred that the substrate 136 be substantially clear with the reflective properties provided by the layer 138 which reflects light at sufficient levels to achieve the transmissive properties for the lamp mask 130 as a whole. It may further be preferred that the layer 138 be diffusely transmissive and diffusely reflective.

Examples of suitable materials for the substrate 136 include, but are not limited to acrylics, polystyrene, polyester, polycarbonate, etc. Examples of suitable materials for the layer 138 include, but are not limited to, e.g., diffusely reflective films such as SCOTCHCAL 7725-20, 3635-30, and 3630-20, all from Minnesota Mining and Manufacturing Company, St. Paul, Minn. Other coatings or films may also be used if they provide desired levels of diffuse transmission and diffuse reflectivity.

One manner in which the lamp masks 130 may be characterized is in the arc over which they attenuate light emitted by the lamps 120. For example, the lamp mask 130 illustrated in FIG. 3 attenuates light emitted by the lamp 120 over an attenuation arc defined by angle $\alpha$ (see also FIG. 4C). It is preferred that the attenuation arc be centered towards the face 140, i.e., a normal axis extending from the face 140 through the center of the lamp 120 preferably bisects the angle $\alpha$. It may be preferred that the attenuation arc over which the lamp masks attenuate light emitted by the lamps 120 be at least about 90° or more. In some instances, it may be preferred that the lamp masks attenuate light emitted by the lamps 120 over an attenuation arc of about 120° or more. In still other instances, it may be preferred that the lamp masks attenuate light emitted by lamps 120 over an attenuation arc of about 150° or more.

At the upper end of the spectrum, it may be preferred that the lamp masks do not attenuate light emitted by the lamps over an arc $\beta$ (see FIGS. 3 and 4C) of about 90° or more, more preferably about 120° or more, and still more preferably about 150° or more. It may be particularly preferred that the lamp masks attenuate light emitted by the lamps 120 over an attenuation arc of about 180° while light emitted from the remainder of the lamp being freely emitted to strike, e.g., the back 150 of the sign without attenuation.

Figure 4A:
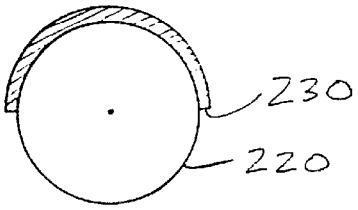
FIGS. 4A–4C are cross-sectional views of alternative lamp masks for use in illuminated sign systems of the present invention.
Figure 4B:
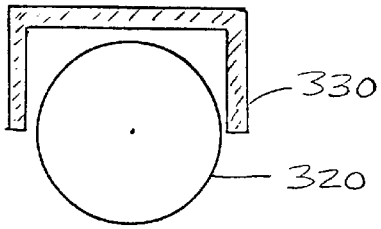
Figure 4C:
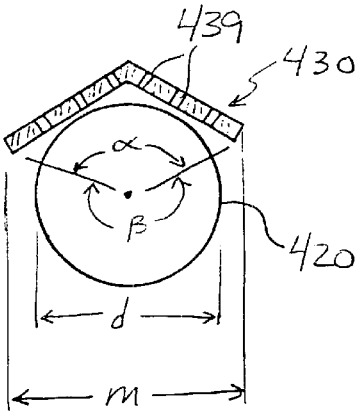

The lamp mask 130 illustrated in FIG. 3 is provided in the shape of a portion of an elongated right circular cylinder. Regardless of the exact shape of the lamp masks 130, it is preferred that they substantially conform to the shape of the lamps 120. Furthermore, the right circular cylindrical shape of lamp mask 130 in FIG. 3 represents only one example of potential lamp mask shapes. FIGS. 4A–4C depict other illustrative embodiments of lamp mask shapes.

The lamp mask 230 in FIG. 4A is provided as an article that is applied directly to the surface of the lamp 220. Lamp mask 230 may be provided as a coating applied to the lamp 220 or, e.g., it may be provided as a film attached to the lamp 220. Any combination of films, sheets, coatings, adhesives, etc. may be used to achieve the desired optical properties of the lamp masks as discussed above.

FIG. 4B depicts another illustrative embodiment of a lamp mask 330 with a rectangular profile that, for purposes of the present invention, substantially conforms to the shape of the underlying lamp 320.

A lamp mask 430 is depicted in FIG. 4C in the shape of two generally planar articles joined together to provide the desired lamp masking properties. The lamp mask 430 also illustrates other variations in lamp masking design including transmissive voids 439 formed through the mask 430. It may further be preferred that the mask 430 be formed of materials that are opaque, with the desired transmissive properties of the mask 430 being provided by the transmissive voids formed therein. In such a design, the voids 439 may preferably occupy a suitable percentage of the surface area of the mask 430, e.g., if 15% transmission is desired, the voids 439 would occupy 15% of the surface area of the mask 430. Alternatively, the mask may be manufactured from partially transmissive materials with the voids 439 supplementing the transmissive properties of the mask 430.

Another manner in which the lamp masks of the present invention may be characterized is also illustrated in FIG. 4C. As discussed above, it may be preferred that the lamp masks substantially conform to the shape of the lamps. This feature may be characterized based on the relative widths of the lamps and lamp masks. Lamp masks that are too wide may undesirably limit light reflected from the back of the sign from reaching the face of the sign. Although the arc over which the lamp masks attenuate light emitted by the lamps can be a function of the width of the lamp mask, proper design of lamp masks that substantially conform to the shape of the lamps can assist in controlling the width of the lamp masks.

Referring to FIG. 4C, for example, the width of the lamp 420, indicated as diameter din FIG. 4C may be related to the width of the lamp mask 430, indicated as mask width m in FIG. 4C. Both of these widths may be considered as the width of the lamp or lamp mask if projected onto the sign face in which these components are located. In some aspects, it may be preferred that the ratio of the mask width to the lamp width (m:d) be about 1.5:1 or less, more preferably about 1.25:1 or less.

Referring back to FIG. 3, the sign face 140 may take on a variety of constructions suitable to achieve the desired optical properties as discussed above. One example of a suitable construction for the face 140 includes a substrate 146 and a layer 148 facing the interior volume of the sign. The substrate 146 and layer 148 may be provided of any suitable combination of materials that reflect light that is incident on the interior surface 142 of the face 140 at the levels discussed above. It may be further preferred that the substrate 146 be substantially transmissive with the layer 148 reflecting light at sufficient levels to achieve the optical properties desired for the face 140 as a whole.

It may be preferred that the layer 148 on the interior surface of the face be diffusely reflective at the desired levels while the substrate 146 is substantially transmissive. By providing the bulk of the diffusely reflective properties at the interior surface 142 of the face 140, absorption by at least the substrate 146 may be reduced or minimized.

Examples of suitable materials for a clear transmissive substrate 146 include, but are not limited to acrylics, polystyrene, polyester, polycarbonate, etc. Layer 148 may be provided as a coating applied to the substrate 146 or, e.g., it may be provided as a film attached to the substrate 146.

Any combination of films, sheets, coatings, adhesives, etc. may be used to achieve the desired optical properties of the face 140 as discussed above. When used with a clear transmissive substrate 146, examples of suitable films for the layer 148 include, but are not limited to, e.g., one or more layers of diffusely reflective films such as SCOTCHCAL 7725-20, 3635-30, 3630-20, all available from Minnesota Mining and Manufacturing Company, St. Paul, Minn.

If the sign face is manufactured of one material that is itself diffusely reflective a separate layer 48 may not be included, see. e.g., face 40 in FIG. 2. Examples of suitable materials for the face that are themselves diffusely reflective, may include materials that include diffusing elements, e.g., PLEXIGLASS 7328 or 2447 (0.125 inches/3.2 mm or 0.188 inches/4.8 mm thick) (available from Autohass North America, Inc., Philadelphia, Pa.) or polycarbonate sheeting such as, e.g., LEXAN SG 400-7328 (0.125 inches/3.2 mm or 0.188 inches/4.8 mm thick) (available from GE Structured Products, Pittsfield, Mass.).

The construction of the back 150 of the sign may also take on a variety of constructions suitable to achieve the desired optical properties as discussed above. One example of a suitable construction for the back 150 includes a substrate 156 and a layer 158 facing the interior volume of the sign. The substrate 156 and layer 158 may be provided of any suitable combination of materials that reflect light that is incident on the interior surface 152 of the back 150 at the levels discussed above.

It may be preferred that the layer 158 on the interior surface of the back 150 be diffusely reflective at the desired levels. By providing the bulk of the diffusely reflective properties at the interior surface 152 of the back 150, absorption by at least the substrate 156 may be reduced or minimized. Layer 158 may be provided as a coating applied to the substrate 156 or, e.g., it may be provided as a film attached to the substrate 156. Any combination of films, sheets, coatings, adhesives, etc. may be used to achieve the desired optical properties of the back as discussed above.

One example of a particularly preferred material for the layer 158 is more than 90% reflective for incident light, e.g., LIGHT ENHANCEMENT FILM 3635-100 available from Minnesota Mining and Manufacturing Company, St. Paul, Minn. (which is reported to be more than 94% reflective).

EXAMPLES

The following examples have been selected merely to further illustrate features, advantages, and other details of the invention. It is to be expressly understood, however, that while the examples serve this purpose, the particular materials and components used, as well as other conditions and details, are not to be construed in a manner that would unduly limit the scope of this invention.

Test Methods

Figure 5:
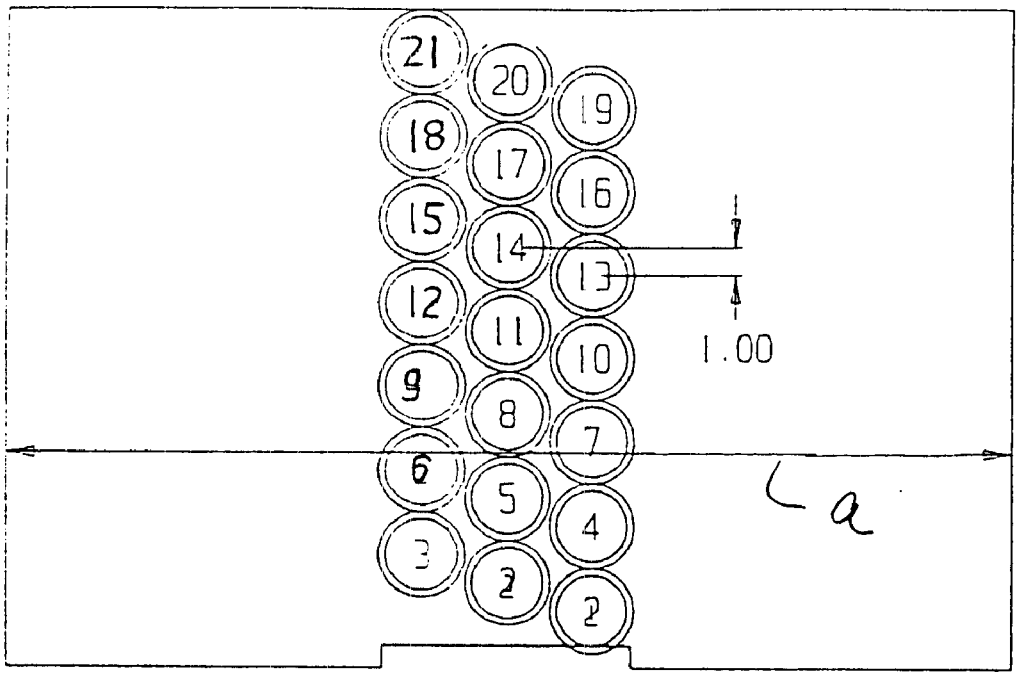
FIG. 5 is a schematic illustration of a testing device used in connection with the examples.

Luminance of illuminated signs in the example below was measured after the signs were operated for one hour to allow the lamp output to stabilize. FIG. 5 illustrates a device designed to measure the luminance at the face of illuminated signs. The device includes a pattern of twenty-one circles arrayed in the illustrated pattern, each circle having a diameter of 3 inches (76 mm). Line a is indicative of lamp direction, i.e., the length of the elongated lamps in the sign. The luminance in each of the circles thus defined was measured using a luminance meter manufactured by Minolta Camera Company (Model LS-110), which was held against the sign face in each circle. The circles were spaced away from the edges of the sign to avoid inconsistencies in luminance due the side walls within the sign.

Average luminance using this device is determined by a simple mathematical average from the photometers arrayed in the pattern illustrated in FIG. 5. Luminance uniformity is calculated as a percentage according to the following equation:

$$\% \text{ Uniformity} = 1 - (\text{Minimum Luminance}/\text{Maximum Luminance})$$

where maximum luminance is the highest luminance measured directly over any one of the lamps and minimum luminance is the lowest luminance measured between any two of the lamps.

Reflectivity and transmission of the films and other materials discussed below was determined using a SPECTRAFLASH 500, available from Datacolor International, Lawerenceville, N.J. The standard technique for using this device was used. The average reflectance/transmission values are over the wavelength range of 500–600 nanometers.

Example 1

An illuminated sign manufactured by ABC Sign Products, Fort Collins, Colo. was used. The sign included a cabinet with a variable depth of 2.5 inches (6.3 cm) to 4 inches (10.2 cm) and face dimensions of 24 inches (61 cm) by 36 inches (91 cm). Four thirty-six inch (91 cm) 25 Watt T8 fluorescent lamps, available from Sylvania, were located within the cabinet. Each of the lamps has a stated output of 2270 lumens.

A lamp mask was provided between each of the lamps and the sign face. The lamp masks were manufactured using a 1.5 inch (4.3 cm) diameter, 0.125 inch (3.2 mm) thick clear acrylic tube that was cut in half such that an arc of 180° remained. The tubes are an optically clear cast acrylic tubing manufactured by Spartech Townsend, Des Moines, Iowa.

A layer of SCOTCHCAL 7725-20 was applied to the surface of the acrylic lamp mask substrate that faces the lamp. This film alone exhibits a diffuse reflectivity of about 87% and diffuse transmission of about 13% (with minimal absorption).

The lamp masks thus manufactured were mounted in front of each lamp, i.e., between the lamp and the sign face. The lamp masks were spaced about 0.125 inch (3.2 mm) from the lamps.

The interior surfaces, e.g., the back, of the sign were lined with LIGHT ENHANCEMENT FILM 3635-100. The lamp spacing ratio was 4:1, with the lamp centers located 1.5 inches (3.8 cm) from the face and 6 inches (15.2 cm) from each other.

The sign face was manufactured using clear acrylic sheeting (PLEXIGLASS, 0.125 inches/3.2 mm) on which a layer of SCOTCHCAL 3635-30 was applied (facing the interior of the sign). This composite face exhibited an average reflectance of approximately 62%.

When measured according to the test methods above, the average luminance of the illuminated sign was 955 Footlamberts (3272 Candela/$m^2$) The uniformity was 4.3%.

Example 2

The sign of Example 1 was tested with a sign face including clear acrylic sheeting (PLEXIGLASS, 0.125 inches/3.2 mm) on which two layers of SCOTCHCAL 3635-30 were applied (facing the interior of the sign). This composite face exhibited an average reflectance of approximately 75%.

When measured according to the test methods above, the average luminance of the illuminated sign was 827 Footlamberts (2833 Candela/$m^2$). The uniformity was 2.4%.

Example 3

The sign of Example 1 was tested with a sign face including clear acrylic sheeting (PLEXIGLASS, 0.125 inches/3.2 mm) on which a layer of SCOTCHCAL 7725-20 was applied (facing the interior of the sign). This film alone exhibits an average reflectance of approximately 87%.

When measured according to the test methods above, the average luminance of the illuminated sign was 635 Footlamberts (2176 Candela/$m^2$). The uniformity was 2.4%.

Example 4

The sign of Example 1 was tested with a sign face manufactured of PLEXIGLASS 7328 sheeting (0.125 inches/3.2 mm thick). This face exhibited an average reflectance of approximately 70%.

When measured according to the test methods above, the average luminance of the illuminated sign was 861 Footlamberts (2950 Candela/$m^2$). The uniformity was 3.4%.

Example 5

The sign of Example 1 was tested with a sign face manufactured of PLEXIGLASS 7328 sheeting (0.188 inches/4.8 mm thick). This face exhibited an average reflectance of approximately 73%.

When measured according to the test methods above, the average luminance of the illuminated sign was 813 Footlamberts (2785 Candela/$m^2$). The uniformity was 3.8%.

Example 6

The sign of Example 1 was tested with a sign face manufactured of PLEXIGLASS 2447 sheeting (0.125 inches/3.2 mm thick). This face exhibited an average reflectance of approximately 36%.

When measured according to the test methods above, the average luminance of the illuminated sign was 1133 Footlamberts (3882 Candela/$m^2$). The uniformity was 5.2%.

Example 7

The sign of Example 1 was tested with a sign face manufactured of PLEXIGLASS 2447 sheeting (0.188 inches/4.8 mm thick). This face exhibited an average reflectance of approximately 35%.

When measured according to the test methods above, the average luminance of the illuminated sign was 1061 Footlamberts (3635 Candela/$m^2$). The uniformity was 5.8%.

Example 8

The sign of Example 1 was tested with a sign face manufactured of LEXAN SG 400-7328 polycarbonate sheeting (0.125 inches/3.2 mm thick). This face exhibited an average reflectance of approximately 69%.

When measured according to the test methods above, the average luminance of the illuminated sign was 806 Footlamberts (2761 Candela/$m^2$). The uniformity was 4.4%.

Example 9

The sign of Example 1 was tested with a sign face manufactured of LEXAN SG 400-7328 polycarbonate sheeting (0.188 inches/4.8 mm thick). This face exhibited an average reflectance of approximately 56%.

When measured according to the test methods above, the average luminance of the illuminated sign was 692 Footlamberts (2371 Candela/$m^2$). The uniformity was 6.0%.

Comparative Example A

The illuminated sign cabinet of Examples 1–9 was modified to provide a lamp spacing ratio of 2:1, with the lamp centers located 3 inches (7.6 cm) from the face and 6 inches (15.2 cm) from each other.

In place of the LIGHT ENHANCEMENT FILM used to line the cabinet, the interior surfaces of the sign were painted white.

The sign face of Example 1 was used (with an average reflectance of approximately 62%).

The lamp masks used in Examples 1–9 were removed from the lamps.

When measured according to the test methods above, the average luminance of the illuminated sign was 730 Footlamberts (2501 Candela/$m^2$). The uniformity was 9.7%. When compared to the examples manufactured according to the present invention as described above, the conventional sign exhibited poorer uniformity despite the lamp spacing ratio of 2:1.

Comparative Example B

The modified cabinet of Comparative Example A was further modified to line the interior surfaces of the enclosure (except for the face) with LIGHT ENHANCEMENT FILM 3635-100.

When measured according to the test methods above, the average luminance of the illuminated sign was 1035 Footlamberts (3546 Candela/$m^2$). The uniformity improved from 9.7% in Comparative Example A to 5.1%.

Comparative Example C

The illuminated sign of Comparative Example B was further modified to include lamp masks as described in connection with Example 1 between each of the lamps and the sign face.

When measured according to the test methods above, the average luminance of the illuminated sign was 902 Footlamberts (3090 Candela/$m^2$). The uniformity was 6.6%. Surprisingly, uniformity with the lamp masks used in a sign with a lamp spacing ratio of 2:1 was reduced as compared to the 5.1% uniformity observed in Comparative Example B. In other words, adding the lamp masks to a sign with a lamp mask spacing ratio actually reduced uniformity.

The preceding specific embodiments are illustrative of the practice of the invention. This invention may be suitably practiced in the absence of any element or item not specifically described in this document. The complete disclosures of all patents, patent applications, and publications are incorporated into this document by reference as if individually incorporated in total.

Various modifications and alterations of this invention will become apparent to those skilled in the art without departing from the scope of this invention, and it should be understood that this invention is not to be unduly limited to illustrative embodiments set forth herein, but is to be controlled by the limitations set forth in the claims and any equivalents to those limitations.

What is claimed is:

1. An illuminated sign comprising:

a face comprising an interior surface facing an interior of the sign and an exterior surface facing away from the interior of the sign, wherein the face diffusely reflects a majority of light incident on the interior surface of the face;

a back located opposite the face, wherein the back comprises a back surface oriented towards the face, wherein the back surface diffusely reflects a majority of light incident on the back surface;

a plurality of lamps located between the face and the back, wherein the lamps and the face are located with a lamp spacing ratio of about 3:1 or more; and a lamp mask located between each of the lamps and the face, wherein each lamp mask transmits only a portion of light incident thereon from its respective lamp.

2. A sign according to claim 1, wherein the lamps comprise elongated lamps, and further wherein the lamp spacing ratio is about 4:1 or higher.

3. A sign according to claim 1, wherein the face diffusely reflects about 70% or more of light incident on the interior surface of the face.

4. A sign according to claim 1, wherein each of the lamp masks attenuates light emitted by its respective lamp over an attenuation arc of about 180°.

5. A sign according to claim 1, wherein each of the lamp masks diffusely transmits about 20% or less of incident light.

6. A sign according to claim 1, wherein each of the lamp masks diffusely transmits about 10% or less of incident light.

7. A sign according to claim 1, wherein each of the lamp masks comprises a plurality of transmissive voids, wherein each of the voids transmits light.

8. A sign according to claim 1, wherein the back surface reflects about 90% or more of normal incident light.

9. A sign according to claim 1, wherein the face diffusely reflects about 80% or more of light incident on the interior surface of the face.

10. A sign according to claim 9, wherein the face diffusely reflects about 90% or more of light incident on the interior surface of the face.

11. A sign according to claim 1, wherein each of the lamp masks attenuates light emitted by its respective lamp over an attenuation arc of no more than about 180°.

12. A sign according to claim 11, wherein the attenuation arc is about 90° or more.

13. A sign according to claim 11, wherein the attenuation arc is about 120° or more.

14. An illuminated sign comprising:

a face comprising an interior surface facing an interior of the sign and an exterior surface facing away from the interior of the sign, wherein the face diffusely reflects a majority of light incident on the interior surface of the face;

a back located opposite the face, wherein the back comprises a back surface oriented towards the face, wherein the back surface diffusely reflects a majority of light incident on the back surface;

a plurality of lamps located between the face and the back; and a lamp mask located between each of the lamps and the face, wherein each lamp mask extends about 180 degrees or less about its respective lamp and diffusely transmits about 20% or less of light incident thereon from its respective lamp.

15. A sign according to claim 14, wherein each of the lamp masks diffusely transmits about 10% or less of normal incident light.

16. A sign according to claim 14, wherein the face diffusely reflects about 90% or more of light incident on the interior surface of the face.

17. A sign according to claim 14, wherein each of the lamp masks comprises a plurality of transmissive voids, wherein each of the voids transmits light.

18. A sign according to claim 14, wherein the back surface reflects about 90% or more of normal incident light.

19. An illuminated sign comprising:

a face comprising an interior surface facing an interior of the sign and an exterior surface facing away from the interior of the sign, wherein the face diffusely reflects about 80% or more of light incident on the interior surface of the face;

a back located opposite the face, wherein the back comprises a back surface oriented towards the face, wherein the back surface diffusely reflects about 90% or more of light incident on the back surface;

a plurality of lamps located between the face and the back, wherein the lamps and the face are located with a lamp spacing ratio of about 3:1 or more; and a lamp mask located between each of the lamps and the face, wherein each lamp mask diffusely transmits about 20% or less of light incident thereon from its respective lamp over an attenuation arc of about 180° or less.

20. A sign according to claim 19, wherein:

the face diffusely reflects about 85% to about 90% of light incident on the interior surface of the face;

the back surface diffusely reflects about 90% or more of light incident on the back surface; and each lamp mask diffusely transmits about 5% to about 15% of light incident thereon from its respective lamp.

21. A sign according to claim 19, wherein:

the face diffusely reflects about 90% of light incident on the interior surface of the face;

the back surface diffusely reflects about 94% or more of light incident on the back surface; and each lamp mask diffusely transmits about 10% of light incident thereon from its respective lamp.

22. A sign according to claim 19, wherein the lamp spacing ratio is about 4:1 or higher.

* * * * *